US007428396B2

(12) United States Patent
Kim

(10) Patent No.: US 7,428,396 B2
(45) Date of Patent: Sep. 23, 2008

(54) POWER TRANSMITTING DEVICE FOR DEVELOPING DEVICE AND IMAGE FORMING APPARATUS WITH THE SAME

(75) Inventor: Sung-dae Kim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 274 days.

(21) Appl. No.: 11/477,677

(22) Filed: Jun. 30, 2006

(65) Prior Publication Data

US 2007/0048018 A1 Mar. 1, 2007

(30) Foreign Application Priority Data

Aug. 25, 2005 (KR) ..... 10-2005-0078431

(51) Int. Cl.
*G03G 15/04* (2006.01)
*G03G 15/01* (2006.01)

(52) U.S. Cl. ..... 399/222; 399/228

(58) Field of Classification Search ..... 399/107, 399/119, 167, 222, 225, 227, 228
See application file for complete search history.

(56) References Cited

U.S. PATENT DOCUMENTS 5,099,278 A * 3/1992 Sato ..... 399/75
5,828,934 A * 10/1998 Tamura et al. ..... 399/228
6,778,798 B2 * 8/2004 Kitahara ..... 399/228

FOREIGN PATENT DOCUMENTS

| | | |
|---|---|---|
| JP | 2000-110906 | 4/2000 |
| JP | 2002-123083 | 4/2002 |
| JP | 2002-156844 | 5/2002 |
| JP | 2004-361567 | 12/2004 |

* cited by examiner

*Primary Examiner*—Hoang Ngo
(74) *Attorney, Agent, or Firm*—Roylance, Abrams, Berdo & Goodman, L.L.P.

(57) ABSTRACT

A power restricting device for a developing device of an image forming apparatus and an image forming apparatus with the same are disclosed. The power restricting device for a developing device of an image forming apparatus includes a driving section with at least one rotational member which is rotated by a power supplied from an external source. The rotational member is movable between a coupled position where it couples with a developing roller and an uncoupled position where it is not coupled with a developing roller. A rotational shaft includes at least one cam which makes the rotational member move between the coupled position and an uncoupled position. A shaft driving section rotates the rotational shaft in one direction. The cam is provided with a cam surface with a first section. The first section is formed such that a line normal to the cam surface at the point that the cam causes the rotational member to begin to couple with the cam surface does not intersect a line connecting a rotational axis of the cam and a maximum stroke point MP of the cam except at the rotational axis of the cam.

20 Claims, 10 Drawing Sheets

POWER TRANSMITTING DEVICE FOR DEVELOPING DEVICE AND IMAGE FORMING APPARATUS WITH THE SAME

CROSS-REFERENCE TO RELATED APPLICATIONS

This application claims the benefit under 35 U.S.C. § 119 (a) of Korean Patent Application No. 2005-78431, filed Aug. 25, 2005, the entire contents of which are hereby incorporated by reference.

BACKGROUND OF THE INVENTION

1. Field of the Invention

The present invention relates to an electrophotographic type image forming apparatus, such as a color copying machine, a color printer or the like. More particularly, the present invention relates to a power transmitting device for transmitting power to each of a plurality of developing devices disposed on an outer circumference of a photosensitive body for developing an electrostatic latent image formed on the photosensitive body to form an image, and an image forming apparatus with the same.

2. Description of the Related Art

In general, an electrophotographic type color image forming apparatus such as a color copying machine, a color printer or the like comprises a plurality of developing devices which develop an electrostatic latent image formed on the photosensitive body to form a toner image. Each developing device is provided with a developing roller for developing an electrostatic latent image corresponding to a predetermined color, for example, one of yellow, magenta, cyan and black.

The developing roller of each developing device is spaced from the photosensitive body by a substantially constant gap, and power is transmitted to the developing roller by a power transmitting device during rotation of the photosensitive body to develop an electrostatic latent image when the developing process is carried out.

FIG. 1 is a view of a conventional power transmitting device 1 for transmitting power to each developing roller of a plurality of developing devices.

This power transmitting device 1 in the developing device comprises a plurality of driving sections 51, a plurality of coupling sections 57, and a rotational shaft 40.

Each driving section 51 comprises a plurality of rotational members 52. A driving gear is mounted to an outer circumferential surface of each rotational member 52, and the driving gear of each rotational member is coupled to a driving motor (not shown) through a gear train of the developing device. Each rotational member 52 has a push cap 53 formed at an upper end, and the push cap is elastically coupled to a frame (not shown) by a support spring (not shown) disposed around the push cap.

Each coupling section 57 comprises a female coupling 58 formed at a lower surface of each rotational member 52 and a male coupling 59 formed on an end portion of a shaft 6 of each developing roller. The female coupling 58 is a coupling recess, and the male coupling 59 is a coupling protrusion having a shape corresponding to the coupling recess of the female coupling 58.

The rotational shaft 40 is coupled with a cam gear 10 through a one-way spring clutch 20 that transmits power in only one direction. The cam gear is coupled to a power restricting motor 27 through a power restricting gear train (not shown). A plurality of cams 42 are provided on an outer circumferential surface of the rotational shaft 40 at regular intervals.

Accordingly, when the rotational shaft 40 is rotated at a certain angle by the power of the power restricting motor transmitted through the cam gear 10, one cam 42 provided on the rotational shaft 40 pushes the push cap 53 of the corresponding rotational member 52 in the direction of the arrow "C" against an elastic force of the support spring. As a result, the female coupling 58 of the rotational member 52 is coupled with the corresponding male coupling 59 of the shaft of the developing roller, and a rotational force of the rotational member 52 rotated by the driving gear coupled with the driving motor of the developing device through the power transmission gear train is transmitted to the shaft 6 of the developing roller.

As shown in FIG. 2A and FIG. 2B, however, each cam 42 provided on the rotational shaft 40 has symmetrical cam surfaces 43. Therefore, normal lines NL1' and NL2' (that is, lines which are normal to the surface of the cam) formed at the points at which the cam begins to contact or begins to disengage the push cap 53 of the corresponding rotational member 52, intersect a line CL' connecting a rotational axis O' and a maximum stroke point MP' of the cam 42.

Accordingly, when the push cap 53 of each rotational member 52 is pushed in the direction of the arrow "C" by the corresponding cam 42, as shown in FIG. 2A, reaction forces F1' and F2' applied to the cam surface 43 by the push cap 53 generate a rotational torque in the opposite direction (arrow B) of the rotational direction (arrow A) of the cam 42, which is rotated by the spring clutch 20 at a start point IP' at which the female coupling 58 begins to couple with the male coupling 59 by the cam surface 43. Also, as shown in FIG. 2B, the reaction forces generate a rotational torque in the direction which is same as the rotational direction (arrow A) of the cam 42 at a finish point LP' at which the female coupling 58 begins to disengage from the male coupling 59 by the cam surface 43.

As shown in FIG. 2B, when the cam surface 43 is halted around the finish point LP' due to an excessive rotation of the cam, the cam 42 receives the rotational torque generated by the reaction force F2' in its rotational direction (arrow A), and causes a clutch spring (not shown) of the spring clutch 20 to be unwound. As a result, the clutch spring is loosened, and the rotational shaft 40 is unstable at the halted position, and may be further rotated in the direction of the arrow A.

As described above, when the rotational shaft 40 is further rotated in the direction of the arrow A and then halts, the rotational member 52 contacts the cam 42 via the push cap 53 and is moved in the direction of the arrow D by an elastic force of the support spring. As a result, the female coupling 58 of the rotational member 52 is unstable when it is disengaged from the male coupling 59 formed on the shaft 6 of the developing roller. Accordingly, the transmission of the rotational force of the rotational member 52 to the shaft 6 of the developing roller is unstable, and it is possible that no force is transmitted to the shaft 6 of the developing roller. Thus, the power transmitting device in the developing device as described above cause inferior electrostatic latent images on the photosensitive drum, and may result cause poor development of the electrostatic latent images.

Accordingly, there is a need for an improved power transmitting device for a developing device in an image forming apparatus.

SUMMARY OF THE INVENTION

An aspect of the present invention is to address at least the above problems and/or disadvantages and to provide at least the advantages described below. Accordingly, an aspect of the present invention is to provide a power transmitting device of a developing device with a cam for enabling power to be transmitted stably, and an image forming apparatus with the same.

In accordance with an aspect of the present invention, a power transmitting device for a developing device of an image forming apparatus comprises a driving section comprising at least one rotational member which is rotated by power supplied from an external source. The at least one rotational member moves between a coupled position where it is coupled with a developing roller and an uncoupled position where it is uncoupled from a developing roller. A rotational shaft comprising at least one cam engages the at least one rotational member to move the at least one rotational member between the coupled position and the uncoupled position, and a shaft driving section rotates the rotational shaft in one direction. The cam is provided with a cam surface with a first section. The first section has a normal line at each point where it contacts the rotational member, and the normal lines are oriented so that they do not intersect a line connecting a rotational axis of the cam and a maximum stroke point MP of the cam, except at the rotational axis of the cam.

The maximum stroke may be positioned at a center between a start point at which the cam surface makes the rotational member begin to be coupled with the developing roller and a finish point at which the cam surface makes the rotational member begin to be uncoupled from the developing roller, and the first section may be located between the maximum stroke point and the finish point.

The first section may be formed such that the normal lines do not intersect a line connecting the rotational axis and the maximum stroke point MP of the cam.

The shape of the first section may comprise a straight line.

The normal lines of the first section may intersect the rotational axis of the rotational shaft.

The shape of the first section may comprise a circular arc, and the center of the circular arc may be located at the rotational axis of the rotational shaft.

The cam surface may further comprise a second section located between the start point and the maximum stroke point MP, and the second section may be formed such that normal lines formed at each point that the second section contacts the rotational member intersect the line connecting the rotational axis and the maximum stroke point MP of the cam.

The shaft driving section may comprise a cam gear coupled with a motor, a spring clutch provided between the cam gear and the rotational shaft. The spring clutch transmits a rotational force of the cam gear in one direction to the rotational shaft. A blocking section for blocking power transmission of the spring clutch when the rotational member is located at the coupled position.

The spring clutch may comprise a first hub formed on the cam gear, a cylindrical body in which the first hub is received, a clutch spring disposed between the first hub and the cylindrical body and slidably contacting the first hub, and a second hub. One end portion of the clutch spring is fixed to the cylindrical body, and another end portion of the clutch spring is fixed to the second hub. The second hub is coupled with the rotational shaft.

The blocking section may comprise at least one protrusion formed on an outer circumferential surface of the cylindrical body of the spring clutch, a locking member moveably supported between a locking position at which the locking member is engaged with the protrusion and a released position at which the locking member is separated from the protrusion, and a solenoid for moving the locking member between the locking position and the released position.

In accordance with another exemplary embodiment of the present invention, an image forming apparatus comprises a photosensitive body on which an electrostatic latent image is formed, a plurality of developing devices, each developing device comprising a developing roller for developing the electrostatic latent image formed on the photosensitive body, and a power transmitting unit for the developing devices for transmitting power of a first motor to each developing roller of the developing devices. The power transmitting unit comprises a driving section comprising at least one rotational member which is rotated by power supplied from the first motor. The at least one rotational member moves between a coupled position where it is coupled with a developing roller and an uncoupled position where it is uncoupled from a developing roller. A rotational shaft comprising at least one cam engages the at least one rotational member to move the at least one rotational member between the coupled position and the uncoupled position, and a shaft driving section rotates the rotational shaft in one direction. The cam is provided with a cam surface with a first section. The first section has a normal line at each point where it contacts the rotational member, and the normal lines are oriented so that they do not intersect a line connecting a rotational axis of the cam and a maximum stroke point MP of the cam, except at the rotational axis of the cam.

The maximum stroke may be positioned at a center between a start point at which the cam surface makes the rotational member begin to be coupled with the developing roller and a finish point at which the cam surface makes the rotational member begin to be uncoupled from the developing roller, and the first section may be located between the maximum stroke point and the finish point.

The first section may be formed such that the normal lines do not intersect a line connecting the rotational axis and the maximum stroke point MP of the cam.

The shape of the first section may comprise a straight line.

The normal lines of the first section may intersect the rotational axis of the rotational shaft.

The shape of the first section may comprise a circular arc, and the center of the circular arc may be located at the rotational axis of the rotational shaft.

The cam surface may further comprise a second section located between the start point and the maximum stroke point MP, and the second section may be formed such that normal lines formed at each point that the second section contacts the rotational member intersect the line connecting the rotational axis and the maximum stroke point MP of the cam.

The shaft driving section may comprise a cam gear coupled with a motor, a spring clutch provided between the cam gear and the rotational shaft. The spring clutch transmits a rotational force of the cam gear in one direction to the rotational shaft. A blocking section for blocking power transmission of the spring clutch when the rotational member is located at the coupled position.

The spring clutch may comprise a first hub formed on the cam gear, a cylindrical body in which the first hub is received, a clutch spring disposed between the first hub and the cylindrical body and slidably contacting the first hub, and a second hub. One end portion of the clutch spring is fixed to the cylindrical body, and another end portion of the clutch spring is fixed to the second hub. The second hub is coupled with the rotational shaft.

The blocking section may comprise at least one protrusion formed on an outer circumferential surface of the cylindrical body of the spring clutch, a locking member moveably supported between a locking position at which the locking member is engaged with the protrusion and a released position at which the locking member is separated from the protrusion, and a solenoid for moving the locking member between the locking position and the released position.

BRIEF DESCRIPTION OF THE DRAWING FIGURES

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

An exemplary embodiment of a power transmitting device of a developing device and an image forming apparatus with the same according to the present invention will now be described in detail, with reference to the accompanying drawing figures.

Figure 3:
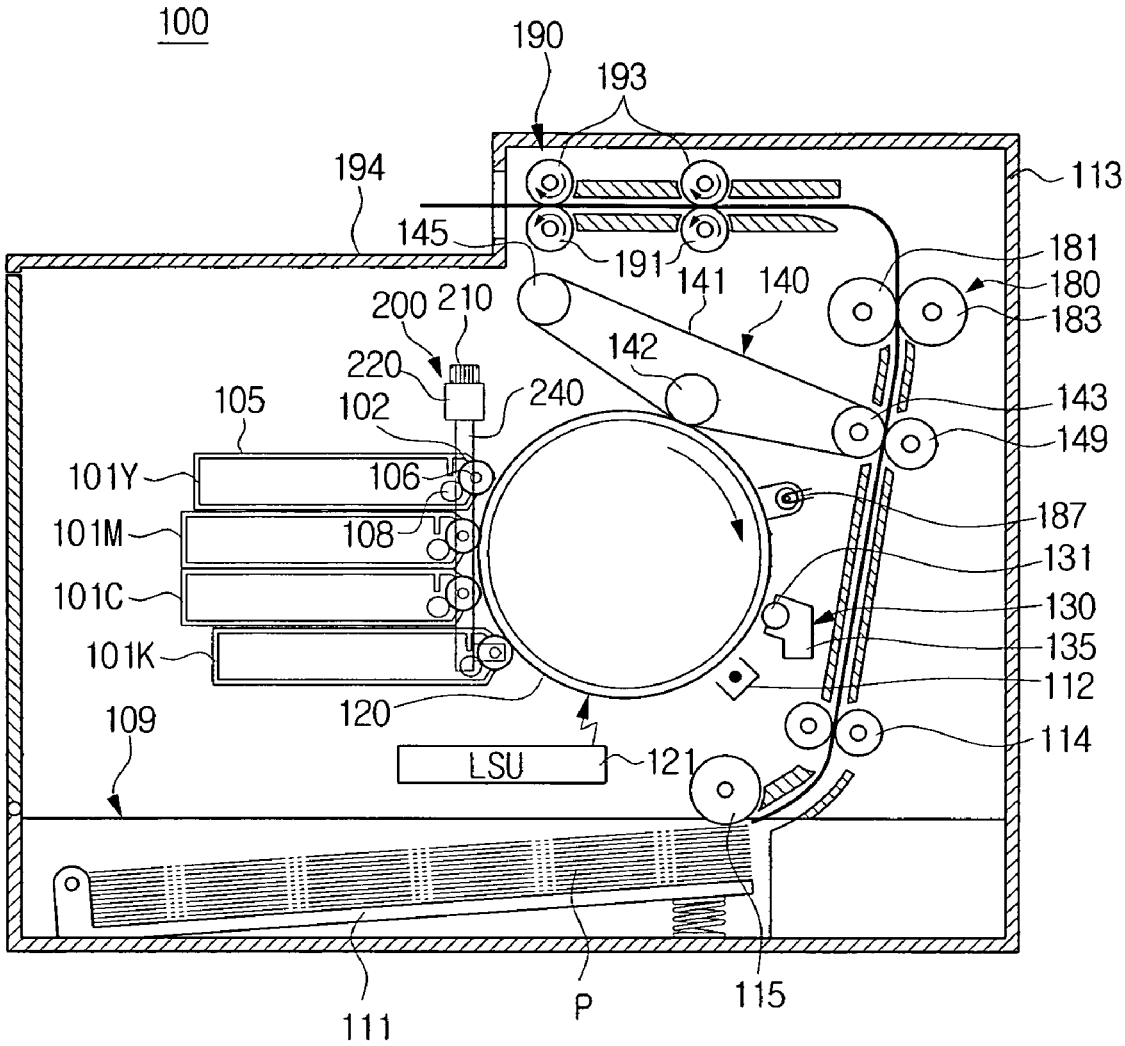
FIG. 3 is a schematic view of a color laser printer provided with a power transmitting device for a developing device according to an exemplary embodiment of the present invention.

FIG. 3 is a schematic view of an image forming apparatus provided with a power transmitting device according to an exemplary embodiment of the present invention.

The image forming apparatus of the exemplary embodiment of the present invention is a color laser printer 100 for printing and outputting data received from an external machine, such as a personal computer or the like.

The color laser printer 100 is provided with a paper sheet feeding unit 109, an image forming unit 110, a power transmitting unit 200 of a developing device, a transferring unit 140, a fixing unit 180, and a paper sheet discharging unit 190.

The paper sheet feeding unit 109 feeds a recording medium P, such as a paper sheet, and comprises a paper sheet feeding cassette 111, a pick up roller 115, and a conveying roller 114. The structure of the paper sheet feeding cassette 111, the pick up roller 115, and the conveying roller 114 is conventional, and well known to those skilled in the art. Therefore, a detailed description is omitted for clarity and conciseness.

The image forming unit 110 comprises a drum-shaped photosensitive body 120 which is continuously rotated in one direction (for example, a clockwise direction) by a driving motor (not shown).

The photosensitive body 120 is, for example, an organic photoconductive (OPC) cylinder made of aluminum. An organic photoconductive layer is coated on an outer surface of the cylinder and both end portions of the cylinder are rotatably fixed to a frame (not shown) to form the photosensitive drum. The photosensitive body 120 is rotated in one direction, for example, a clockwise direction, by a gear train (not shown) which receives power from a driving gear train (not shown) of a driving motor installed in a main body 113. The structures of a driving gear train and a gear train for the photosensitive drum are well known to those skilled in the art, and thus, a detailed description is omitted.

An erasing device 187, a cleaner 130 for cleaning the photosensitive body, a charging device 112, a laser scanning unit ("LSU") 121, and a plurality of developing devices containing predetermined colored developing agents (that is, for example, a black developing device 101K containing a black (K) colored developing agent, a cyan developing device 101C containing a cyan (C) colored developing agent, a magenta developing device 101M containing a magenta (M) colored developing agent and a yellow developing device 101Y containing a yellow (Y) colored developing agent) are disposed around an outer circumference of the photosensitive body 120 along the rotational direction of the photosensitive body 120.

The erasing device 187 is used to eliminate a charge potential on the surface of the photosensitive body 120, and comprises an erasing lamp.

The cleaner 130 is used to remove waste developing agent remaining on the photosensitive body 120 after a color image formed on the photosensitive body 120 by the black, cyan, magenta and yellow developing devices 101K, 101C, 101M and 101Y is transferred to an image-transferring belt 141 of the transferring unit 140. The cleaner 130 comprises a cleaning member 131 such as a cleaning roller, and a waste developing agent storage section 135.

The cleaning member 131 is pivotably installed on a fixing bracket provided in the waste developing agent storage section 135, and is operated such that the cleaning member is moved into contact with the photosensitive body 120 with a certain pressure by a moving means (not shown) such as a cam or a solenoid or is moved away from the photosensitive body.

The charging device 112 comprises, for example, a scorotron charging device spaced apart from a surface of the photosensitive body 120 by a certain interval. A predetermined charging bias voltage is applied to the charging device by a charging bias voltage power source (not shown) to form a charge potential on a surface of the photosensitive body 120.

The LSU 121 scans a laser beam generated at a laser diode or the like to a surface of the photosensitive body 120 which has been charged to a predetermined potential by the charging device 112 in response to an image signal received from an external device such as a personal computer. The laser beam discharges the area where it contacts the surface of the photosensitive body to form an electrostatic latent image on the photosensitive body 120.

Each of the black, cyan, magenta and yellow developing devices 101K, 101C, 101M and 101Y is provided with a developing roller 102, a developing agent-supplying roller 108, a blade 107 for regulating the thickness of the developing agent layer, and a developing device case 105. The black, cyan, magenta, and yellow developing devices 101K, 101C, 101M and 101Y have the same structure, and so the structure of only the yellow developing device 101Y is described below as an example.

The developing roller 102 supplies the developing agent to the electrostatic latent image formed on the photosensitive body 120 by the LSU 121 which corresponds to the yellow Y color to develop the electrostatic latent image. The developing roller is arranged to face the photosensitive body 120 at a constant gap, for example, 0.2 mm and is rotated by a rotational force transmitted from a driving motor (which is not shown) in the opposite direction of the rotational direction of the photosensitive drum 120, that is, in the counterclockwise direction. The rotational force is controlled by the power transmitting unit 200 for the developing device. A developing bias voltage, which is lower than that of the developing agent-supplying roller 108 bias voltage, is applied to the developing roller 102 from a developing bias voltage source (not shown).

The developing agent-supplying roller 108 supplies yellow Y colored developing agent to the developing roller 102 using a potential difference between the developing agent-supplying roller 108 and the developing roller 102. The developing agent-supplying roller 108 is disposed such that a lower surface of one side of the developing roller 102 contacts the developing agent-supplying roller 108 to form a nip. In the developing device case 105, the yellow Y colored developing agent flows into the lower space between the developing agent-supplying roller 108 and the developing roller 102. The developing agent-supplying roller 108 is rotated in the same direction as the developing roller 102, that is, in a counterclockwise direction.

Also, a developing agent-supplying bias voltage (which is higher than the developing bias voltage of the developing roller 102) is applied to the developing agent-supplying roller 108 from a developing agent-supplying roller bias voltage source (not shown). Accordingly, an electric charge is injected into the yellow (Y) colored developing agent in the lower space between the developing agent-supplying roller 108 and the developing roller 102 and the yellow Y colored developing agent is charged. The yellow Y colored developing agent bonds to the developing roller 102 (which has a relative low potential) and moves to the nip between the developing agent-supplying roller 108 and the developing roller 102.

The blade 107 for regulating a thickness of developing agent layer regulates the yellow (Y) colored developing agent supplied to the developing roller 102 via the developing agent-supplying roller 108 to form a thin layer of the developing agent with a predetermined thickness on the developing roller 102.

The yellow (Y) colored developing agent is contained in the developing device case 105, and the developing roller 102, the developing agent-supplying roller 108 and the blade 107 for regulating a thickness of developing agent layer are disposed in the developing device case.

Figure 4:
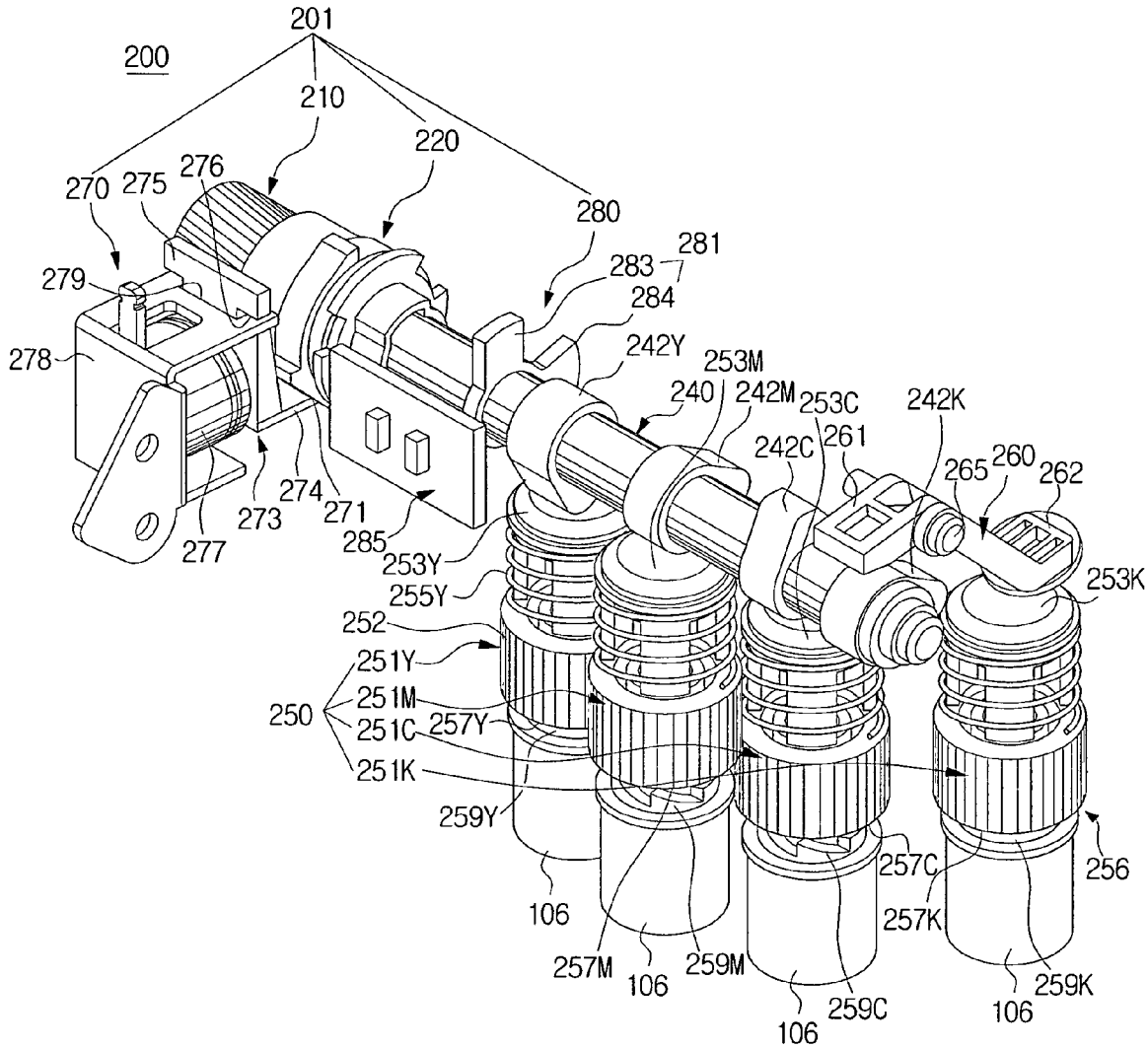
FIGS. 4 and 5 are perspective views of the power transmitting device shown in FIG. 3.
Figure 5:
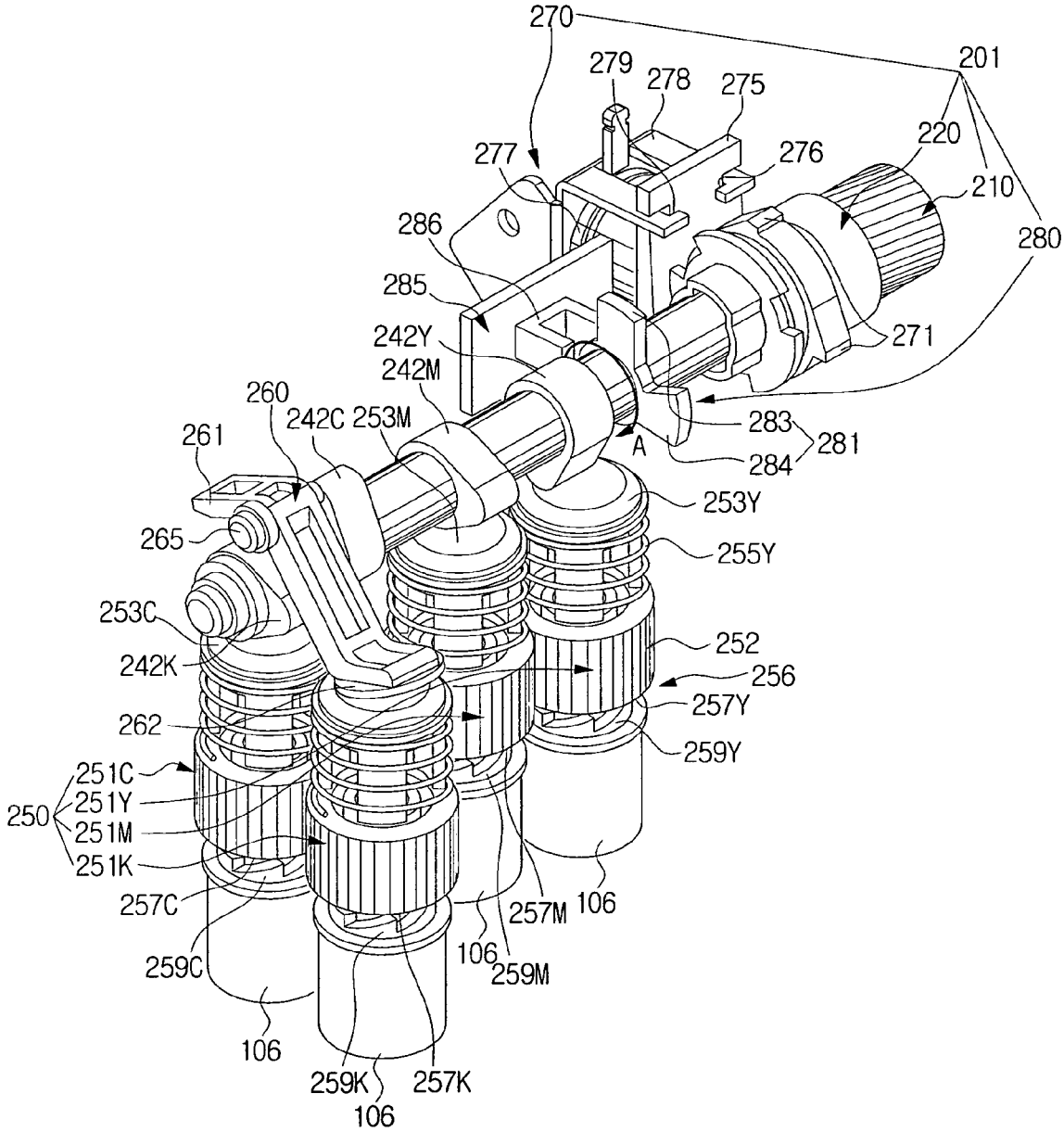

As shown in FIG. 4 and FIG. 5, the power transmitting unit 200 of the developing device comprises a driving section 250, a coupling section 256, a rotational shaft 240, a shaft driving section 201, and a sensor section 280.

The driving section 250 is used to transmit power generated at a driving motor for the developing device provided in the main body 113 to a shaft of the developing roller 102 of each developing device 101K, 101C, 101M and 101Y. The driving section comprises black, cyan, magenta and yellow rotational members 251K, 251C, 251M and 251Y. A driving gear 252 is provided on an outer circumference of each rotational member.

The driving gear 252 of each of rotational members 251K, 251C, 251M and 251Y is coupled with the driving motor for the developing device through the gear train (not shown) for the developing device. The structure of the gear train for the developing device is well known to those skilled in the art, and so a detailed description is omitted for conciseness.

The rotational members 251K, 251C, 251M and 251Y have the same structure, and so only the structure of the yellow rotational member 251Y is described below as an example.

A yellow female coupling 257Y (described in further detail below) of the coupling section 256 is provided at a lower side of the yellow rotational member 251Y, and a yellow push cap 253Y that contacts a yellow cam 242Y (described in further detail below) is provided at an upper side of the yellow rotational member 251Y.

The yellow rotational member 251Y is elastically pressed by a yellow support spring 255Y which is supported by a support frame (not shown) so that the yellow push cap 253Y contacts the yellow cam 242Y.

The coupling section 256 is provided with black, cyan, magenta and yellow female couplings 257K, 257C, 257M and 257Y and black, cyan, magenta and yellow male couplings 259K, 259C, 259M and 259Y.

Each of the female couplings 257K, 257C, 257M and 257Y comprises a coupling recess formed at a lower side of each of the rotational members 251K, 251C, 251M and 251Y. The coupling recess can be a recess with an appropriate shape, for example, a triangular or an arrow shape, on the coupling.

Figure 1:
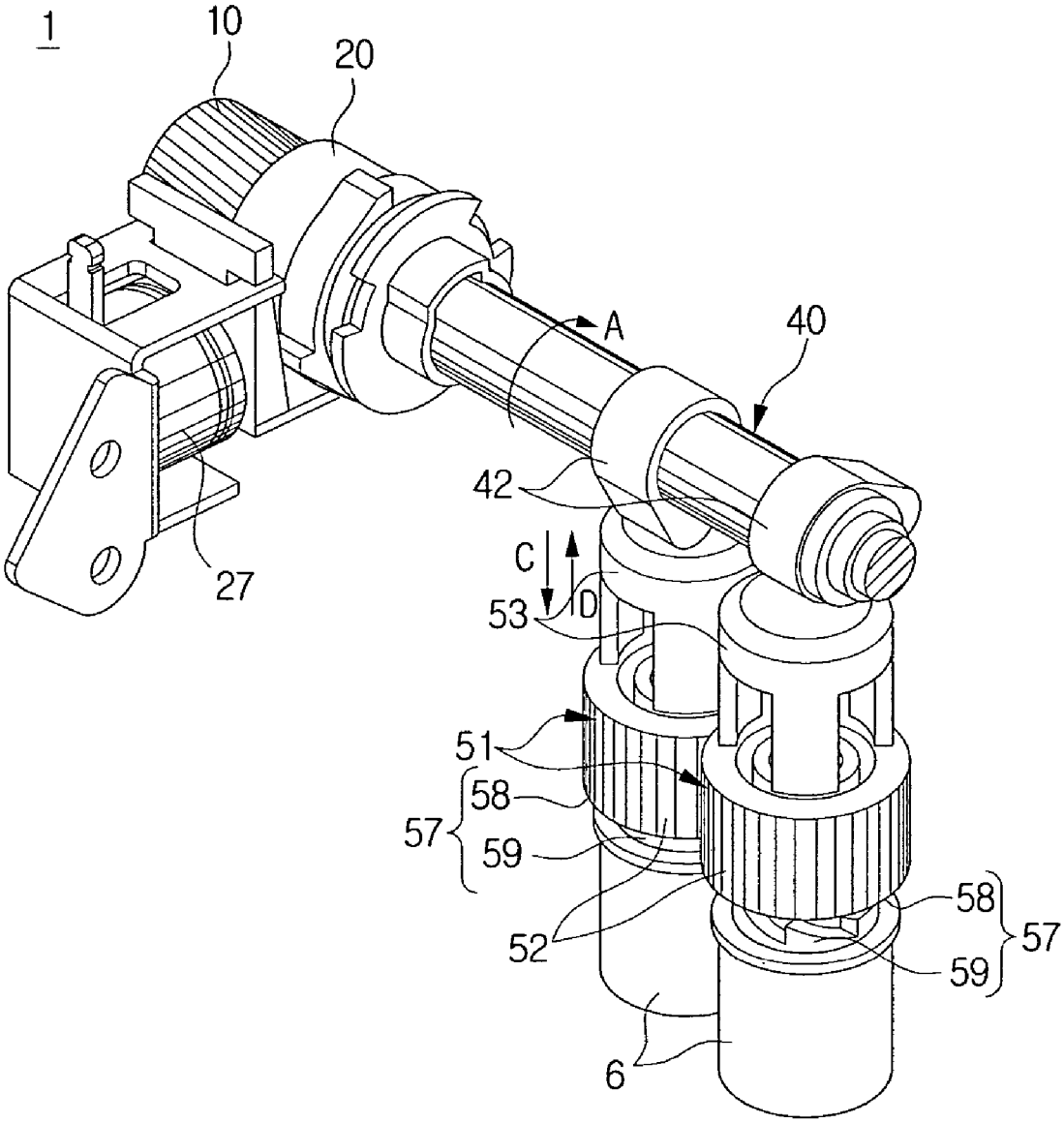
FIG. 1 (RELATED ART)
FIG. 1 is a partial perspective view of a conventional power transmitting device for a developing device.
Figure 2A:
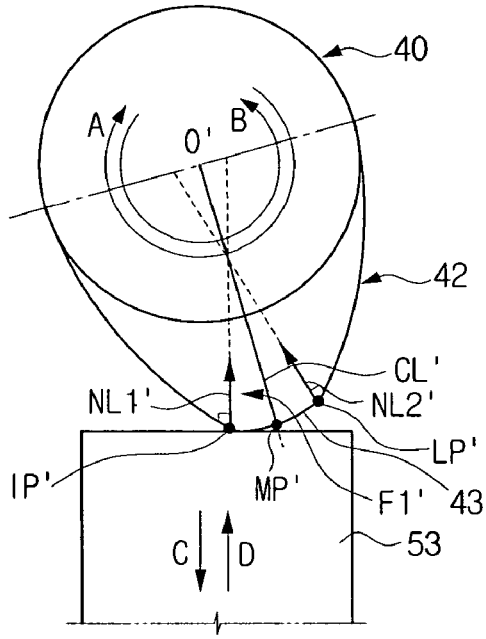
FIG. 2A (RELATED ART)
FIGS. 2A and 2B are side views showing an example of the operation of a cam in the power transmitting device shown in FIG. 1.
Figure 2B:
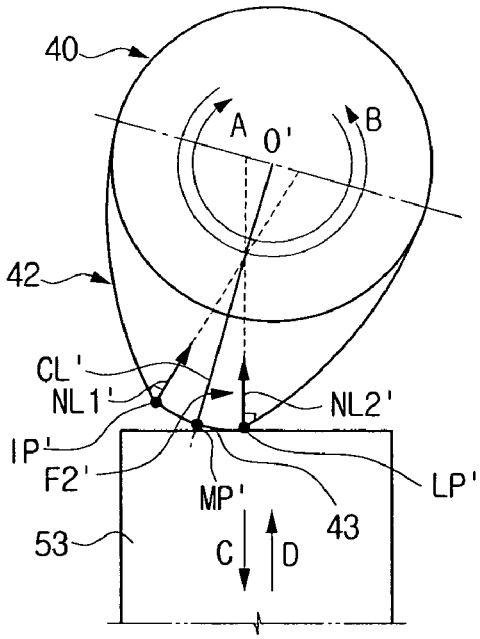
FIG. 2B (RELATED ART)

Coupling protrusions are formed at end portions of each developing roller 102 and act as male couplings 259K, 259C, 259M and 259Y. The shape of the coupling protrusions correspond to the shape of the coupling recess so that the coupling protrusions are coupled with the coupling recess when the rotational members 251K, 251C, 251M, 251Y are pushed in the direction of the arrow C (refer to FIG. 1) by the cams 242K, 242C, 242M, 242Y.

The rotational shaft 240 is rotatably fixed to a support frame and comprises black, cyan, magenta and yellow cams 242K, 242C, 242M, 242Y. The cams are operated such that each of the rotational members 251K, 251C, 251M and 251Y is moved toward the shaft 106 of the corresponding developing roller 102, and so each rotational member is located at a coupled position. At the coupled position of each of the rotational members 251K, 251C, 251M and 251Y, the coupling recess acts as a female coupling 257K, 257C, 257M and 257Y and is coupled with the corresponding coupling protrusion that acts as a male coupling 259K, 259C, 259M and 259*y*.

The black, cyan, magenta and yellow cams 242K, 242C, 242M, 242Y are provided on an outer circumferential surface of the rotational shaft 240 at regular intervals.

Above the black cam 242K, a black cam power supplying member 260 is supported by a support shaft 265 for supplying the cam force of the black cam 242K to the black rotational member 251K, which is located out of the operating range of the black cam 242K. The black cam power supplying member 260 has an L shape so that, when a first end portion 261 is pushed by the black cam 242K, a second end portion 262 pushes the cap member 253K of the black rotational member 251K in the direction of the arrow C to receive the coupling protrusion of a black male coupling 259K in the coupling recess of the black female coupling 257K.

Figure 7:
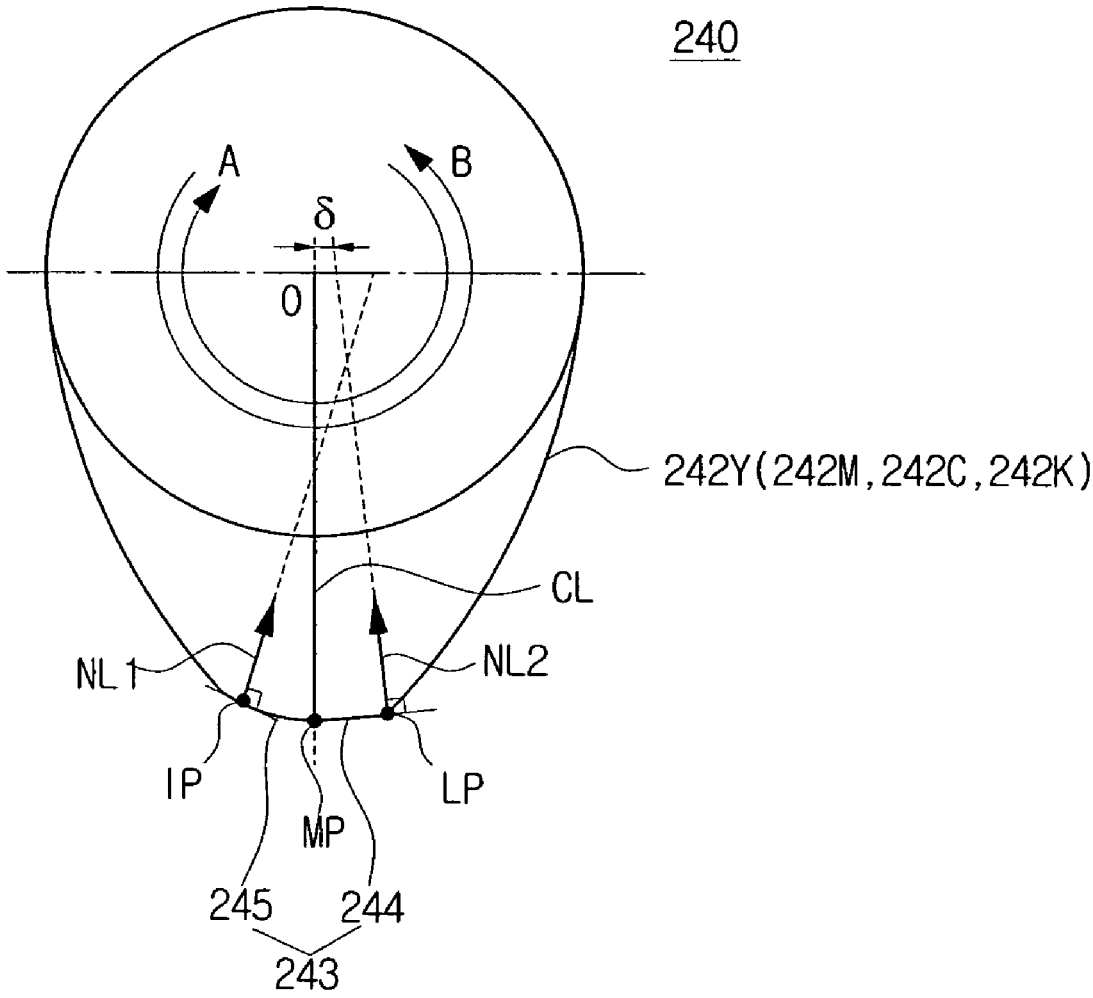
FIG. 7 is a side view of a cam of a rotational shaft of the power transmitting device shown in FIG. 4.

As shown in FIG. 7, each of the cams 242K, 242C, 242M and 242Y is provided with a cam surface 243 having a first section 244 and a second section 245.

The first section 244 of the cam surface 243 is located between a maximum stroke point MP and a finish point LP at which the cam surface 243 makes the rotational member 251K, 251C, 251M or 251Y begin to escape from a coupled position when the cam 251K, 251C, 251M or 251Y is rotated. The first section 244 of the cam surface 243 has a shape such that lines NL1 and NL2, which are normal lines at the points at which the push cap 253K, 253C, 253M or 253Y of the rotational member 251K, 251C, 251M or 251Y contact the cam, do not intersect a line CL connecting a rotational axis O and the maximum stroke point MP of the cam 251K, 251C, 251M or 251Y 42, except at the rotational axis O. The cam surface has a start point IP, which is the point on the cam surface 243 where the cam makes the rotational member 251K, 251C, 251M or 251Y begin to be coupled with the development roller 106 when the cam 242K, 242C, 242M or 242Y is rotated. The maximum stroke point MP is positioned in the middle between the start point IP and the finish point LP.

In this exemplary embodiment, as shown in FIG. 7, the first section 244 of the cam surface 243 is formed such that the normal line NL2 intersects the line CL connecting the rotational axis O and the maximum stroke point MP of the cam 251K, 251C, 251M or 251Y 42 to form an angle of δ. In this case, the outer surface of the first section 244 may form a straight line.

Figure 8A:
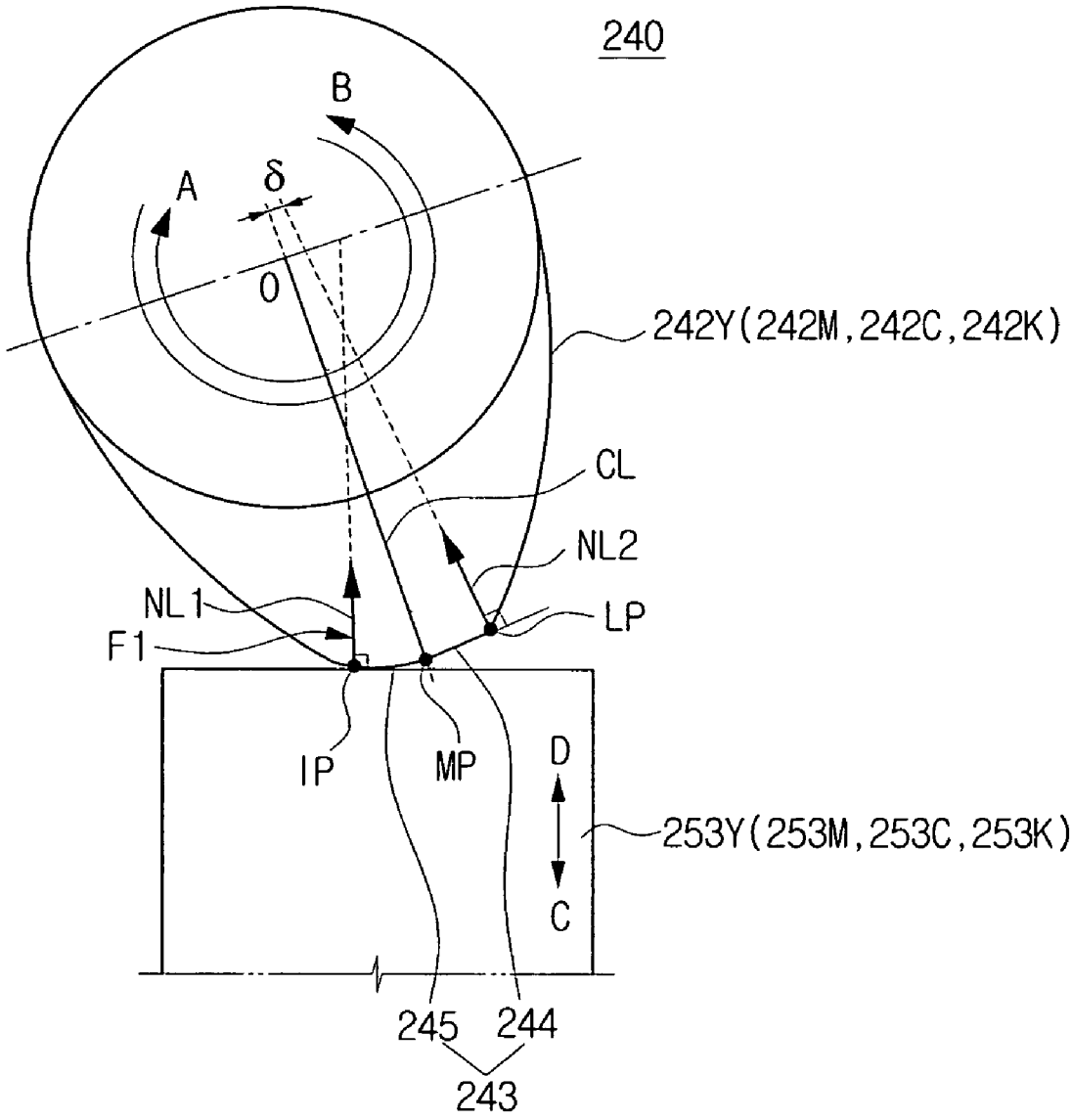
FIG. 8A and FIG. 8B are side views showing examples of the operation of the cam of the power transmitting device shown in FIG. 7.
Figure 8B:
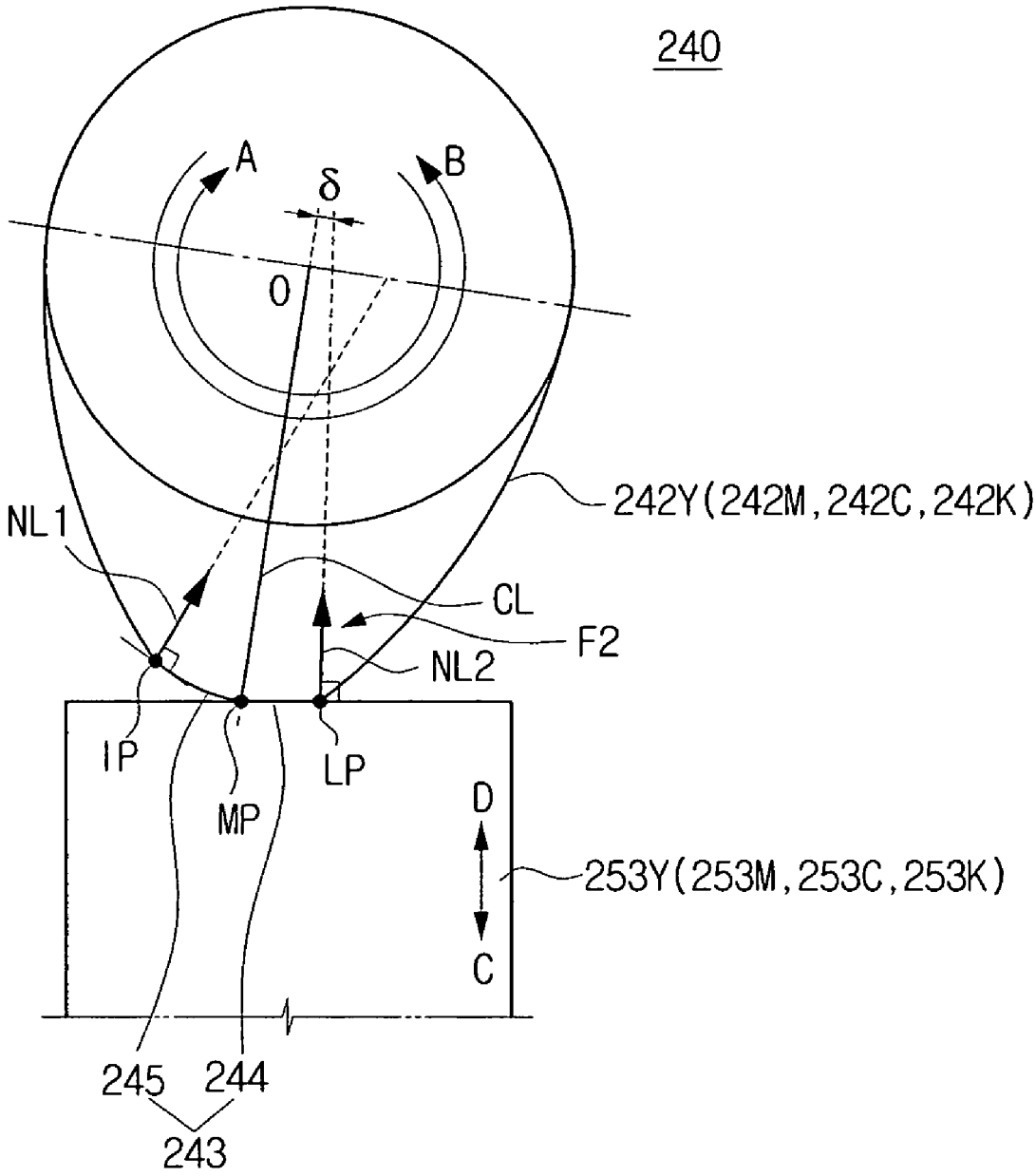

If the cam surface 243 is formed as described above, and the cam 242K, 242C, 242M or 242Y is rotated too far and halted around the finish point LP, as shown in FIG. 8B, the reaction force F2 applied to the first section 244 of the cam surface 243 due to the push cap 253K, 253C, 253M or 253Y generates a rotational torque in the direction B, which is opposite to a rotational direction A of the cam 242K, 242C, 242M or 242Y (which is rotated at the start point IP by a cam gear 210 and a spring clutch 220 (described below)). Accordingly, a rotational torque in the direction B, which is opposite to a rotational direction A of the cam 242K, 242C, 242M or 242Y is applied to a second end portion 225 of a clutch spring 223 (see FIG. 6) of the spring clutch 220 halted by a locking member 273 of a blocking section 270 (described below). Thus, the clutch spring is wound on first and second hubs 221 and 230. As a result, the rotational torque of the cam 242K, 242C, 242M or 242Y is transmitted to the cam gear 210, therefore, the cam 242K, 242C, 242M or 242Y is halted by the cam gear 210 coupled with a power restricting motor through a power restricting gear train, so that the cam is stably maintained at a stop position.

Figure 9:
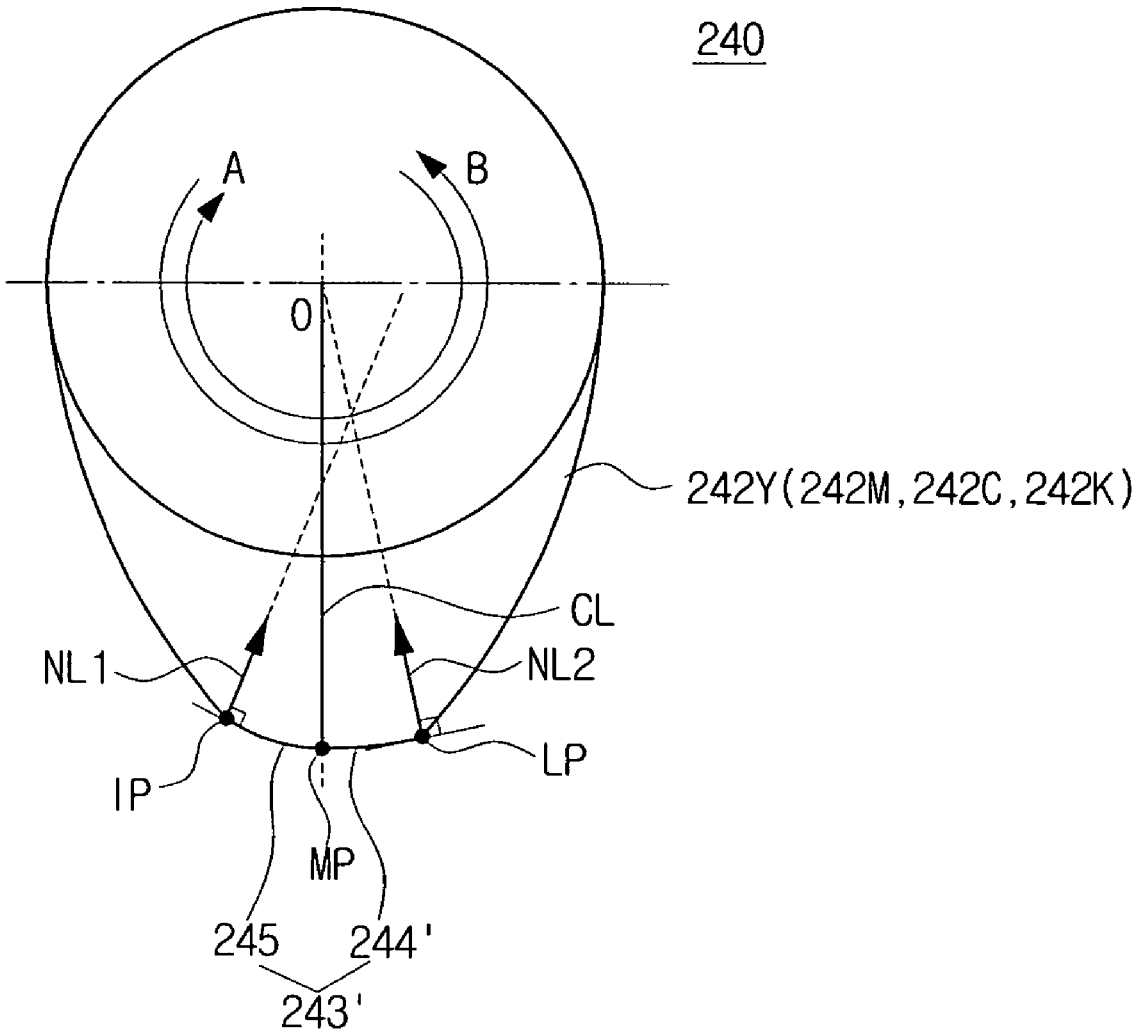
FIG. 9 is a view of another embodiment of the cam of the power transmitting device shown in FIG. 4.

Optionally, as shown in FIG. 9, a first section 244' of a cam surface 243' is formed such that an extension line of the normal line NL2 intersects the rotational axis O. In this case, the outer circumferential surface of the first section 244' is a circular arc with its center located at the rotational axis O of the cam 240.

With this configuration, when the cam 242K, 242C, 242M or 242Y is rotated too far and halted around the finish point LP, the reaction force F2 applied to the first section 244' of the cam surface 243' by the push cap 253K, 253C, 253M or 253Y is exerted toward the rotational axis O. Accordingly, the cam 242K, 242C, 242M or 242Y is not rotated in any direction and can be stably maintained at the stop position.

Referring again to FIG. 7, the second section 245 of the cam surface 243 is located between the start point IP and the maximum stroke point MP, and the second section is formed such that the normal line NL1 intersects the line CL connecting the rotational axis O and the maximum stroke point MP.

Accordingly, as shown in FIG. 8A, when the cam 242K, 242C, 242M or 242Y is incompletely rotated and halted around the start point IP, the reaction force F1 applied to the second section 245 of the cam surface 243 due to the push cap 253K, 253C, 253M or 253Y generates a rotational torque in the direction B, which is opposite to a rotational direction A of the cam 242K, 242C, 242M or 242Y. Therefore, the clutch spring 223 of the spring clutch 220 is wound on the first and second hubs 221 to transmit the rotational torque of the cam 242K, 242C, 242M or 242Y to the cam gear 210, and the cam 242K, 242C, 242M or 242Y is stably maintained at a stop position by the cam gear 210.

Referring to FIG. 4 and FIG. 5, the shaft driving section 201 transmits a rotational force in one-way (that is, the direction of arrow A) to the rotational shaft 240 and comprises the cam gear 210, the spring clutch 220, the blocking section 270, and the sensor section 280.

The cam gear 210 is coupled with a power restricting gear train (not shown) through a power restricting motor (not shown) to drive the cam gear by the operation of the power restricting motor. The structure of a power restricting gear train is well known to those skilled in this art, and so a detailed description is omitted for conciseness.

In the above description, the cam gear 210 is driven by the power restricting motor, not the motor for driving the developing device. The cam gear may, however, be driven by the motor for driving the developing device through an additional gear train (not shown).

The spring clutch 220 is used to transmit the rotational force of the cam gear 210 to the rotational shaft 240 in the direction of arrow A and is provided between the cam gear 210 and the rotational shaft 240.

Figure 6:
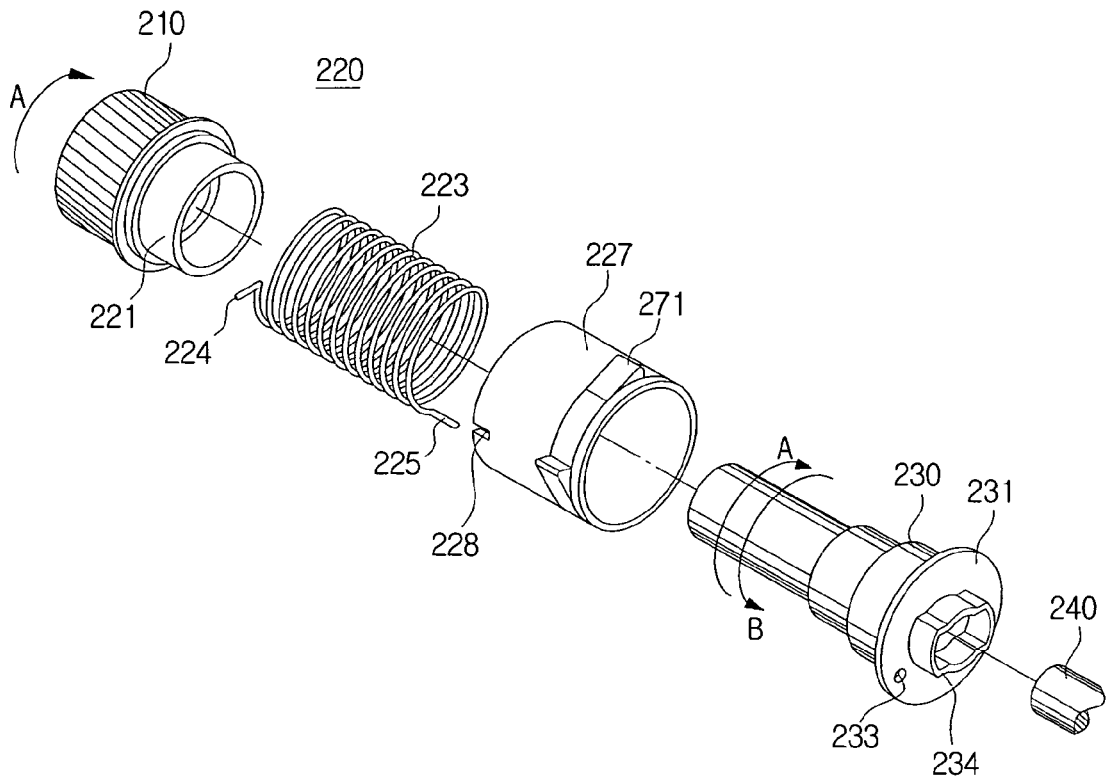
FIG. 6 is an exploded perspective view of a spring clutch of the power transmitting device shown in FIG. 4.

As shown in FIG. 6, the spring clutch 220 is provided with a first hub 221 formed at one side of the cam gear 210.

The first hub 221 is rotatably received in a cylindrical body 227, the clutch spring 223 is disposed between the first hub 221 and the cylindrical body 227, and the clutch spring slidably contacts the first hub 221.

A first end portion 224 of the clutch spring 223 is fixed to a spring fixing cutout 228 of the cylindrical body 227, and a second end portion 225 is fixed to a spring fixing hole 233 formed on a flange 231 of the second hub 230.

The second hub 230 is coupled with the rotational shaft 240 through a fixing part 234 of the flange 231, and the second hub is disposed in the cylindrical clutch spring 223.

As shown in FIG. 4 and FIG. 5, the blocking section 270 is provided for blocking power transmission of the spring clutch 220 when the rotational member 251K, 251C, 251M or 251Y is located at the coupled position by rotation of the rotational shaft 240 by a certain angle. The blocking section 270 is disposed on the outside of the cylindrical body 227 of the spring clutch 220.

The blocking section 270 is provided with a plurality (for example, 5(five)) inclined protrusions 271 formed on an outer circumferential surface of the cylindrical body 227, at regular intervals.

A locking member 273 is disposed outside the inclined protrusion 271, and is provided with an engaging protrusion 274 which is capable of engaging the inclined protrusion 271. An engaging section 275 is formed above the locking member 273. The engaging section 275 has a hinge groove 276 disposed in a supporting groove 279 of a solenoid bracket 278, so that the locking member 273 can be pivoted between a locking position at which the engaging protrusion 274 is engaged with an inclined protrusion 271 and a released position at which the engaging protrusion is separated from the inclined protrusions 271.

A solenoid 277 is fixed to the solenoid bracket 278, and provided with a plunger (not shown) made from metal or a magnet. The plunger moves the locking member between the locking position and the released position. The plunger is pressurized by a compression spring (not shown) to push the locking member 273 toward the locking position. Accordingly, when the solenoid is turned on, the plunger is pulled by a magnetic force generated at an inner coil (not shown) of the solenoid to make the locking member 273 move to the released position. In contrast, when the solenoid is turned off, the plunger is returned to its original position by the elastic force of the compression spring to make the locking member 273 move to the locking position, The sensor section 280 is provided for sensing whether the rotational shaft 270 is accurately halted at the stop position or not when the rotational shaft 270 is halted by the blocking section 270 after the cam 242K, 242C, 242M or 242Y moves the corresponding rotational member 251K, 251C, 251M or 251Y to the coupled position. The sensor section comprises a sensing actuator 281 and a sensing section 285.

The sensing actuator 281 is provided with first and second sensing protrusions 283 and 284 formed on the rotational shaft 240 at certain angles for enabling the sensing actuator to be rotated together with the rotational shat 240. An optical sensor 286 acts as the sensing section 285. The optical sensor comprises a light emitting part and a light receiving part for sensing the first and second sensing protrusions 283 and 284. The optical sensor 286 counts the number and time intervals of signals generated when the first and second sensing protrusions 283 and 284 are passed between the light emitting part and the light receiving part and determines whether the rotational shaft 240 is correctly halted at the stop position.

The operation of the power transmitting unit 200 for the developing device as described above will now be described.

First, once the power restricting motor is driven for driving one of the developing devices, for example, the yellow developing device 110Y, power of the power restricting motor is transmitted to the cam gear 210 via the power restricting gear train.

In the spring clutch 220, at this time, the cylindrical body 227 fixing the first end portion 224 of the clutch spring 220 is locked by the locking member 273 to inhibit the cylindrical body from being rotated. Thus, although the cam gear 210 rotates, the first hub 221 slides with respect to the clutch spring 223, and the first hub 221 is idle.

Subsequently, once the solenoid 277 is turned on, the plunger is pulled by the magnetic force generated at the inner coil of the solenoid 277 to make the locking member 273 move to the released position at which the engaging protrusion 274 is released from the inclined protrusion 271.

Subsequently, once the locking member 273 is moved to the released position, the cylindrical body 227 of the spring clutch 220 is rotated in the rotational direction of the cam gear 210 (that is, the direction of arrow A) by sliding friction between the first hub 221 and the clutch spring 223. The rotation of the cylindrical body 227 allows the clutch spring 223, which is fixed to the spring fixing hole 233 of the flange 231 through the second end portion 225 is wound on the first and second hubs 221 and 230 and contacts the outer surfaces of the first and second hubs 221 and 230. As a result, the rotational force of the cam gear 210 is transmitted to the rotational shaft 240 via the first and second hubs 221 and 230 and the clutch spring 223. Thus, the rotational shaft 240 is rotated in the direction of the arrow A.

As described above, the rotational shaft 240 is rotated by a certain angle so that the yellow cam 242Y pushes the yellow push cap 253Y of the yellow rotational member 251Y in the direction of arrow C against an elastic force of the yellow support spring 255Y as shown in FIG. 8A. As a result, the female coupling 257Y is coupled with the male coupling 259Y formed on the shaft 106 of the developing roller 101 of the yellow developing device 101Y. Therefore, the rotational force of the yellow rotational member 251Y (which is rotated by the driving gear Y coupled to the gear train for the developing device) is transmitted to the shaft 106 of the developing roller 102.

Again, referring to FIG. 3, the transferring unit 140 transfers a colored developing agent-image formed on the photosensitive body 120 by the image forming unit 110 to an image receiving medium P, which is provided with the image-transferring belt 141, a first and second transferring rollers 142 and 149.

The image-transferring belt 141 is used to transfer the colored developing agent-image formed on the photosensitive body 120 to the image receiving medium P and is rotated in the medium conveying direction (a counterclockwise direction in FIG. 3) by a driving roller 143 and a driven roller 145.

The surface of the image-transferring belt 141 is, for example, coated with an organic photoconductive layer to allow the colored developing agent-image formed on the photosensitive body 120 to be transferred to the image-transferring belt 141.

A belt cleaner (not shown) is disposed at the image-transferring belt 141 around the driven roller 145 for removing waste developing agent remaining on the surface of the image-transferring belt 141 after transferring the colored developing agent-image to the image receiving medium P. The belt cleaner may comprise a belt cleaning blade (not shown) for cleaning the image-transferring belt 141 and a reservoir (not shown) for collecting the waste developing agent removed by the belt cleaning blade.

The first transferring roller 142 is disposed such that the first transferring roller pressurizes an inner side surface of the image transferring belt 141 toward the photosensitive body 120 with a certain pressure. A primary transferring bias voltage is applied to the first transferring roller 142 from a transferring bias electric power source section (not shown) to enable the colored developing agent-image formed on the photosensitive body 120 to be transferred to the first transferring roller 142.

The second transferring roller 149 is provided for transferring the colored developing agent-image transferred to the image transferring belt 141 to the image receiving medium P, and is disposed so as to make the image receiving medium P contact the driving roller 143 with a certain pressure. The transferring bias electric power source applies a secondary transferring bias voltage to the second transferring roller 149 to enable the colored developing agent-image transferred to the image transferring belt 141 to be transferred to the image receiving medium P.

The fixing unit 180 is provided for fixing the transferred colored-developing agent image to the image receiving medium P, and is provided with a heating roller 181 and a pressurizing roller 183. The heating roller 181 has a heater (not shown) provided therein for fixing a toner image to the image receiving medium P using high temperature heat. The pressurizing roller 183 is provided and is pressurized against the heating roller 181 by an elastic pressurizing means (not shown) for pressurizing the image receiving medium P.

The paper sheet discharging unit 190 is used for discharging the image receiving medium P on which the colored developing agent-image is fixed toward a paper sheet discharging tray 194. The paper sheet discharging unit 190 comprises paper sheet discharging rollers 191 and backup rollers 193.

The operation of the electrophotographic type color printer 100 according to the exemplary embodiment of the present invention described above will now be described in detail, with reference to FIGS. 3 to 8B.

First, a print order is received, and the photosensitive body 120 is continuously rotated by the photosensitive body driving motor, and a surface of the photosensitive body 120 is uniformly charged by the charged device 112.

The surface of the photosensitive drum 120 is exposed to light by the LSU 121, and an electrostatic latent image corresponding to the first formed color, for example, yellow Y, is formed on the photosensitive body.

While the yellow Y electrostatic latent image is formed on the photosensitive body 120, a control section (not shown) compares the detecting signal transmitted from sensor section 280 and the location information stored in a memory (not shown) and decides the current position of the rotational shaft 280 on the basis of the comparison.

If the control section decides that the yellow rotational member 251Y is maintained at the coupled position by the rotational shaft 240 and the yellow cam 242, the control section controls an operation of the power restricting motor such that the rotational shaft 240 does not rotate and is maintained at this position. The developing device driving motor is driven to rotate the developing roller 102 and the developing agent-supplying roller 108 of the yellow developing device 101Y, On the other hand, if the control section decides that the yellow rotational member 251Y is not maintained at the coupled position by the rotational shaft 240 and the yellow cam 242, the control section controls the operation of the power restricting motor such that the rotational shaft 240 and the yellow cam 242 are rotated by a required angle to make the yellow rotational member 251Y maintain a coupled position, in the manner described above. The developing device driving motor is driven to rotate the developing roller 102 and the developing agent-supplying roller 108 of the yellow developing device 101Y.

After that, when a front end portion of the yellow electrostatic latent image reaches a developing location, a developing bias voltage is applied to the developing roller 102 of the yellow developing device through the developing bias electric power source section.

As a result, the yellow electrostatic latent image is developed by yellow Y developing agent supplied from the developing agent-supplying roller 108 by the developing roller 101 of the yellow developing device 101Y, and so a continuous yellow developing agent image stretching from a front end portion to a rear end portion of the yellow Y electrostatic latent image is formed.

After the yellow Y developing agent image is formed and a rear end portion of the yellow Y developing agent image passes through the developing position, the developing bias voltage applied to the developing roller 102 of the yellow developing device 101Y is shut off by the developing bias electric power source.

At this time, the yellow Y developing agent image formed on the photosensitive body 120 passes through the transferring unit 140 (and the erasing device 187 and the cleaner 130 for cleaning the photosensitive body, which are not operating), and is placed again below the charging device 112. The cleaning member 131 of the cleaner 130 is moved away from the photosensitive body, except when the cleaner 130 for cleaning the photosensitive body is operated. Accordingly, the cleaning member 131 does not contact the passing yellow developing agent image and the developing agent image is not damaged.

The photosensitive body 120 on which the yellow Y developing agent image is formed is uniformly charged by the charging device 112, and an electrostatic latent image corresponding to a color, for example, a magenta M color of the image formed secondly by the LSU 121 overlaps the yellow Y developing agent image, and is then developed.

While the magenta M electrostatic latent image is formed on the photosensitive body 120, the rotational shaft 240 is rotated in the manner as described above, and the magenta rotational member 2251M is located at the coupled position through the magenta cam 242M.

Thereafter, when a front end portion of the magenta M electrostatic latent image reaches the developing position of the magenta developing device 101M, a developing bias voltage is applied to the developing roller 102 of the magenta developing device 101M through the developing voltage bias electric power source.

As a result, the magenta M electrostatic latent image is developed by the developing roller 102 of the magenta developing device 101M, and so a magenta M developing agent image stretching from a frond end portion to a rear end portion of the magenta M electrostatic latent image is formed.

After the magenta M developing agent image is formed and a rear end portion of the magenta M developing agent image passes the developing position, the developing bias voltage applied to the developing roller 102 of the magenta developing device 110M is blocked by the developing bias electric power source.

Thereafter, the cyan C and black K colored images are overlapped and formed in the same manner, and, as a result, the color developing agent image is formed.

The color developing agent image formed on the photosensitive body 120 is transferred to the image transferring belt 141 by the primary bias voltage applied by the first transferring roller 142.

After the image is transferred, the charge potential on the photosensitive drum 120 is removed by the erasing device 187, and any waste developing agent remaining on the surface of the photosensitive body 120 is removed by the cleaning member 131 of the cleaner 130, which is moved into contact with the body by a moving means.

The color developing agent image transferred to the image transferring belt 141 is then transferred to the image receiving medium P by the pressure and the secondary transferring bias voltage applied by the second transferring roller 149. The image receiving medium P is picked-up by the pickup roller 115 at the paper sheet feeding cassette 111 and then conveyed to the second transferring roller 149 by the conveying roller 114.

The image receiving medium P to which the color developing agent image has been transferred is conveyed to the fixing unit 180, and the color developing agent image is fixed to the image receiving medium by heat and pressure supplied by the heating roller 181 and the pressure roller 183. Then, the image receiving medium P is discharged to the paper sheet discharging tray 194 by the paper sheet discharging roller 191 and the backup roller 193 of the paper sheet discharging unit 190.

As described above, in the power transmitting device for the developing device and the image forming apparatus having the same according to the exemplary embodiments of the present invention, the cam surface of the cams are configured so that the reaction forces applied to the cams by the push caps of the rotational members are exerted in an opposite direction to the rotational direction of the cams, that is, the direction which is opposite to the rotational direction of the rotational shaft rotated by the cam gear of the shaft driving section. Therefore, the above-described exemplary embodiments of the present invention prevent the cams from rotating even when the cams are not halted at the correct stop position. Thus, the rotational members can be coupled stably with the shafts of the developing rollers by the male and female couplings of the coupling section and the reliability of the power transmission of the developing device is enhanced.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A power transmitting device for a developing device of an image forming apparatus, comprising:

a driving section comprising at least one rotational member which is rotated by power supplied from an external source, the at least one rotational member moving between a coupled position where it is coupled with a developing roller and an uncoupled position where the at least one rotational member is uncoupled from the developing roller;

a rotational shaft comprising at least one cam, the cam engaging the at least one rotational member to move the at least one rotational member between the coupled position and the uncoupled position; and a shaft driving section for rotating the rotational shaft in one direction, wherein the cam is provided with a cam surface with a first section, the first section having a normal line at each point where it contacts the at least one rotational member, the normal lines being oriented so that they do not intersect a line connecting a rotational axis of the cam and a maximum stroke point MP of the cam except at the rotational axis of the cam.

2. The power transmitting device according to claim 1, wherein the maximum stroke is positioned at a center between a start point at which the cam surface makes the at least one rotational member begin to be coupled with the developing roller and a finish point at which the cam surface makes the at least one rotational member begin to be uncoupled from the developing roller, and the first section is located between the maximum stroke point and the finish point.

3. The power transmitting device according to claim 2, wherein the first section is formed such that the normal lines do not intersect a line connecting the rotational axis and the maximum stroke point MP of the cam.

4. The power transmitting device according to claim 3, wherein the shape of the first section comprises a straight line.

5. The power transmitting device according to claim 2, wherein the normal lines of the first section intersect the rotational axis of the rotational shaft.

6. The power transmitting device according to claim 5, wherein the shape of the first section comprises a circular arc, and the center of the circular arc is located at the rotational axis of the rotational shaft.

7. The power transmitting device according to claim 2, wherein the cam surface further comprises a second section located between the start point and the maximum stroke point MP, the second section having a normal line at each point where it contacts the at least one rotational member, the second section being formed such that normal lines intersect the line connecting the rotational axis and the maximum stroke point MP of the cam.

8. The power transmitting device according to claim 1, wherein the shaft driving section comprises:

a cam gear coupled with a motor;

a spring clutch provided between the cam gear and the rotational shaft, the spring clutch transmitting a rotational force of the cam gear in one direction to the rotational shaft; and a blocking section for blocking power transmission of the spring clutch when the rotational member is located at the coupled position.

9. The power transmitting device according to claim 8, wherein the spring clutch comprises:

a first hub formed on the cam gear;

a cylindrical body in which the first hub is received;

a clutch spring disposed between the first hub and the cylindrical body and slidably contacting the first hub, the clutch spring comprising one end portion fixed to the cylindrical body; and a second hub to which another end portion of the clutch spring is fixed, the second hub being coupled with the rotational shaft.

10. The power transmitting device according to claim 8, wherein the blocking section comprises:

at least one protrusion formed on an outer circumferential surface of the cylindrical body of the spring clutch;

a locking member moveably supported between a locking position at which the locking member is engaged with the protrusion and a released position at which the locking member is separated from the protrusion; and a solenoid for moving the locking member between the locking position and the released position.

11. An image forming apparatus, comprising:

a photosensitive body on which an electrostatic latent image is formed;

a plurality of developing devices, each developing device comprising a developing roller for developing the electrostatic latent image formed on the photosensitive body; and a power transmitting unit for the developing devices for transmitting power of a first motor to each developing roller of the developing devices, comprising:

a driving section comprising at least one rotational member which is rotated by power supplied from the first motor, the at least one rotational member moving between a coupled position where it is coupled with a developing roller and an uncoupled position where the at least one rotational member is uncoupled from the developing roller;

a rotational shaft comprising at least one cam, the cam engaging the at least one rotational member to move the at least one rotational member between the coupled position and the uncoupled position; and a shaft driving section for rotating the rotational shaft in one direction, wherein the cam is provided with a cam surface with a first section, the first section having a normal line at each point where it contacts the at least one rotational member, the normal lines being oriented so that they do not intersect a line connecting a rotational axis and a maximum stroke point MP of the cam except at the rotational axis of the cam.

12. The image forming apparatus according to claim 11, wherein the maximum stroke is positioned at a center between a start point at which the cam surface makes the at least one rotational member begin to be coupled with the developing roller and a finish point at which the cam surface makes the at least one rotational member begin to be uncoupled from the developing roller, and the first section is located between the maximum stroke point and the finish point.

13. The image forming apparatus according to claim 12, wherein the first section is formed such that the normal lines do not intersect a line connecting the rotational axis and the maximum stroke point MP of the cam.

14. The image forming apparatus according to claim 13, wherein the shape of the first section comprises a straight line.

15. The image forming apparatus according to claim 12, wherein the normal lines of the first section intersect the rotational axis of the rotational shaft.

16. The image forming apparatus according to claim 15, the shape of the first section comprises a circular arc, and the center of the circular arc is located at the rotational axis of the rotational shaft.

17. The image forming apparatus according to claim 12, wherein the cam surface further comprises a second section located between the start point and the maximum stroke point MP, the second section having a normal line at each point where it contacts the at least one rotational member, the second section being formed such that normal lines intersect the line connecting the rotational axis and the maximum stroke point MP of the cam.

18. The image forming apparatus according to claim 11, wherein the shaft driving section comprises:

a cam gear coupled with a motor;

a spring clutch provided between the cam gear and the rotational shaft, the spring clutch transmitting a rotational force of the cam gear in one direction to the rotational shaft; and a blocking section for blocking power transmission of the spring clutch when the rotational member is located at the coupled position.

19. The image forming apparatus according to claim 18, wherein the spring clutch comprises:

a first hub formed on the cam gear;

a cylindrical body in which the first hub is received;

a clutch spring disposed between the first hub and the cylindrical body and slidably contacting the first hub, the clutch spring comprising one end portion fixed to the cylindrical body; and a second hub to which another end portion of the clutch spring is fixed, the second hub being coupled with the rotational shaft.

20. The image forming apparatus according to claim 18, wherein the blocking section comprises:

at least one protrusion formed on an outer circumferential surface of the cylindrical body of the spring clutch;

a locking member moveably supported between a locking position at which the locking member is engaged with the protrusion and a released position at which the locking member is separated from the protrusion; and a solenoid for moving the locking member between the locking position and the released position.

* * * * *